US005372657A

United States Patent [19]

Hanaue et al.

[11] Patent Number: 5,372,657

[45] Date of Patent: Dec. 13, 1994

[54] AMORPHOUS MATERIAL FOR REGENERATOR

[75] Inventors: Yasuhiro Hanaue; Etsuji Kimura; Takuo Takeshita, all of Omiya; Uichiro Mizutani, Nagoya; Yoshiki Hoshino, Aichi, all of Japan

[73] Assignees: Mitsubishi Materials Corp.; Mitsubishi Denki Kabushiki Kaisha, Tokyo, Japan

[21] Appl. No.: 944,090

[22] Filed: Sep. 11, 1992

[30] Foreign Application Priority Data

Sep. 13, 1991 [JP] Japan ..... 3-263108

[51] Int. Cl.[5] ..... C22C 45/02; C22C 45/04; C22C 45/00

[52] U.S. Cl. ..... 148/304

[58] Field of Search ..... 138/304

[56] References Cited

U.S. PATENT DOCUMENTS 4,995,923 2/1991 Mizumoto et al. ..... 148/304
5,060,478 10/1991 Fukamichi ..... 148/304

FOREIGN PATENT DOCUMENTS 0191107 8/1986 European Pat. Off. .
0193743 9/1986 European Pat. Off. .
0327293 8/1989 European Pat. Off. .
0411591 2/1991 European Pat. Off. .
283414 4/1976 France .
52-030473 8/1977 Japan .
1-310269 12/1989 Japan .

*Primary Examiner*—Deborah Yee
*Attorney, Agent, or Firm*—Birch, Stewart, Kolasch & Birch

[57] ABSTRACT

Disclosed herein is an amorphous material in the form of foil for the regenerator, which is prepared by quenching a melt of a rare earth alloy by injection toward the surface of a roll running at a high speed, said alloy being composed of one or more rare earth elements in an amount of 50–99 atomic %, with the remainder being one or more iron family elements. This amorphous material has a large, stable specific heat capacity at very low temperatures.

14 Claims, 1 Drawing Sheet

AMORPHOUS MATERIAL FOR REGENERATOR

BACKGROUND OF THE INVENTION

1. Field of the Invention

The present invention relates to an amorphous material which is suitable for a regenerator of the refrigerator due to its good mechanical properties and thermal properties.

2. Description of the Prior Art

Miniature-sized refrigerator are now in general use for the vacuum equipment employed in the production of semiconductors by ion implantation or sputtering. They fall into two main groups: those equipped with a regenerator and those equipped with a heat exchanger. Those belonging to the first group, which are based on the Gifford-McMahon cycle or Stirling cycle, are commonly used for refrigeration at liquid nitrogen temperatures or liquid hydrogen temperatures due to their simple structure and high reliability.

The material packed in the regenerator of the refrigerator is required to have a large specific heat capacity and good thermal conductivity in the range of operating temperatures. In the past, copper, lead and alloys thereof have been used as a regenerator material. They have a disadvantage of rapidly decreasing in specific heat capacity at 20° K. or below, which presents difficulties in producing very low temperatures in that range.

To solve this problem, there has been proposed a rare earth alloy as the regenerator material which has an anomalous heat capacity due to magnetic phase transition (Japanese Patent Publication No. 30473/1977). Improvements on it have also been disclosed (Japanese Patent Laid-open Nos. 310269/1989 and 1050/1991).

The conventional rare earth alloy used as the regenerator material is an intermetallic compound having a low mechanical strength. In other words, it is too brittle to be formed into a foil or coil. Therefore, it is used mostly in the form of fine powder with a particle diameter of 10 μm–1 mm. Fine powders of rare earth alloy need great care in handling because of extremely high chemical activity. In addition, excessively fine powder increases resistance to the flow of the working fluid and escapes from the net containing it.

SUMMARY OF THE INVENTION

Accordingly, a primary object of the present invention is to provide an amorphous material of a rare earth alloy for the regenerator which is free of the above-mentioned problems involved in the prior art technology. The regenerator material in the present invention is amorphous for the improvement of its mechanical strength, so that it can be formed into a foil or coil and it maintains a large specific heat capacity over a comparatively broad range of very low temperatures.

The present invention is embodied in an amorphous material for the regenerator which comprises one or more rare earth elements in an amount of 50–99 atomic%, with the remainder being one or more iron family elements.

According to the present invention, the rare earth element includes one or more members selected from Er, Ho, Dy, and Tb, and the iron family element includes one or more members selected from Ni, Co, Ru, Pd, Rh, Ir, Os, Pt, and Fe.

DETAILED DESCRIPTION OF THE INVENTION

According to the present invention, the rare earth alloy should contain rare earth elements in an amount of 50–99 atomic%. With an amount less than 50 atomic%, it has an unduly low specific heat capacity. With an amount in excess of 99 atomic%, it is not readily made amorphous. The remainder of the alloy constituents should be one or more iron family elements selected from Ni, Co, Ru, Pd, Rh, Ir, Os, Pt, and Fe. Owing to the combination of rare earth elements and iron family elements, the alloy is easily made amorphous and has a high specific heat capacity. Incidentally, less than 50% of the iron family elements may be replaced by any one or more elements selected from Au, Ag, Cu, Al, Ga, Si, and Ge, so as to improve the above-mentioned properties of the alloy.

An amorphous alloy is usually produced by the single-roll method which consists of injecting a melt of an alloy toward the surface of a roll running at a high speed, thereby subjecting the melt to rapid quenching. This single-roll method can be used to produce the amorphous rare earth alloy of the present invention. The resulting product is in the form of a foil having a thickness of the order of micrometers to tens of micrometers. This foil is by far tougher than those of intermetallic compounds and can be wound up easily. Therefore, the rolled foil can be packed into the regenerator more densely, while offering less resistance to the flow of the working fluid, than the conventional rare earth alloy in the form of powder.

In the case of conventional rare earth alloys, the anomalous heat capacity due to magnetic phase transition manifests itself as a narrow peak. By contrast, the amorphous rare earth alloy in the present invention gives a broader peak with a gentle slope. In other words, it exhibits thermal properties (specific heat capacity) most desirable for the regenerator of the refrigerator. The effect of the rare earth alloy being amorphous is significant when it is used at very low temperatures (4° K. or below) in the refrigerator for helium liquefaction.

According to the present invention, the amorphous rare earth alloy for the regenerator has such a high mechanical strength that it can be formed into a foil or coil. Therefore, it offers less resistance to the flow of the working fluid than the conventional regenerator in the form of a powder. In addition, it has a large heat capacity at very low temperatures and hence produces a good cooling effect for a long period of time.

EXAMPLE 1

Figure 1:
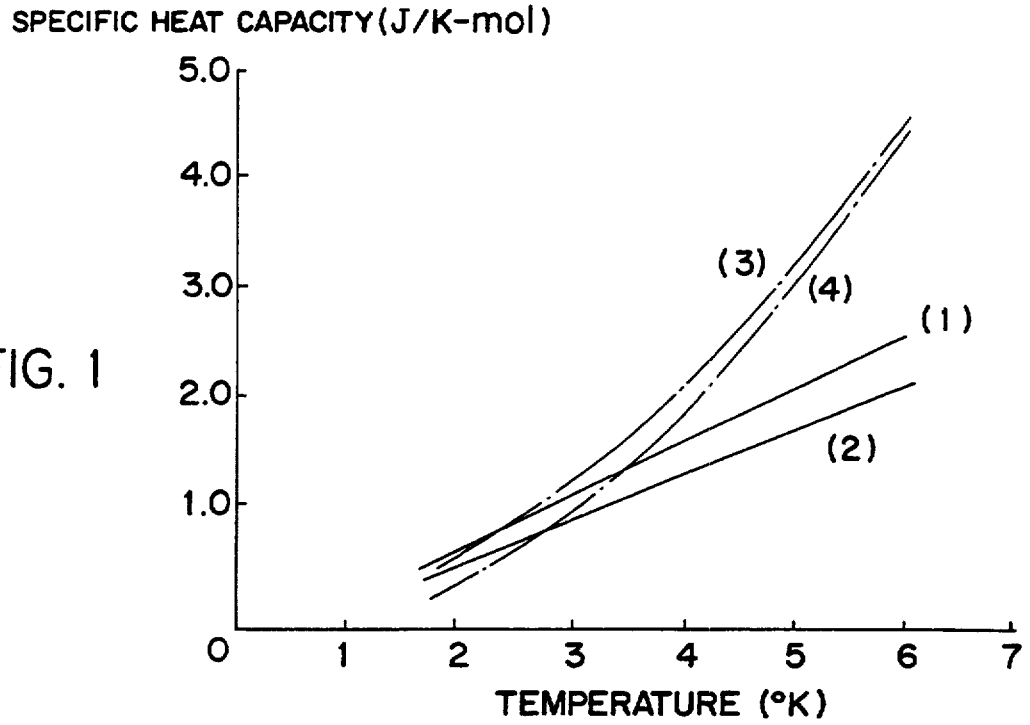
FIG. 1 is a graph showing the specific heat capacity vs. temperature of the amorphous rare earth alloys in Example 1 and 2. and the conventional rare earth alloys.

A rare earth alloy ($Er_{65}Ni_{35}$) composed of 65 atomic% Er and 35 atomic% Ni was prepared by melting 42 g of Er (purity 99.9%) and 7.8 g of Ni (purity 99.9%) using an argon arc melting furnace. The alloy was melted in a crucible of quartz glass by high-frequency induction heating under an argon atmosphere. The melt at about 1000° C. was injected through a nozzle by the pressure of argon gas toward the surface of a steel roll rotating at about 5000 rpm, so that the melt was quenched. Thus there was obtained foil (17 μm thick) of an amorphous rare earth alloy. The amorphousness was confirmed by X-ray diffractometry. The specific heat capacity of the foil at temperatures in the range of 1.6° K. to 6° K. was measured. The results are shown in FIG. 1 (solid line 1). For comparison, the specific heat capacity of a crystalline rare earth alloy ($Er_3Ni+Er_3Ni_2$) of the same composition ($Er_{65}Ni_{35}$) as above at temperatures in the same range as above was also measured. The results are also shown in FIG. 1 (chain line 3).

It is noted from FIG. 1 that the specific heat capacity of the rare earth alloy in this example is less dependent on temperature than that of the conventional crystalline rare earth alloy. At very low temperatures below 2.5° K., the former is greater than the latter. At temperatures in the range of 2.5° K. to 6° K., the former remained in the range of about 0.8 to 2.5. This indicates that the amorphous rare earth alloy of the present invention exhibits good characteristics in specific heat capacity at very low temperatures like the above temperatures.

EXAMPLE 2

The same procedure as in Example 1 was repeated to prepare a rare earth alloy ($Er_{60}Ni_{40}$) composed of 60 atomic% Er and 40 atomic% Ni. The rare earth alloy was made into amorphous alloy foil (22 μm thick) by heating to about 1100° C. in the same manner as in Example 1. The specific heat capacity of the amorphous alloy foil at temperatures in the range of 1.6° K. to 6° K. was measured. The results are shown in FIG. 1 (solid line 2). For comparison, the specific heat capacity of a crystalline rare earth alloy ($Er_3Ni+Er_3Ni_2$) of the same composition as above at temperatures in the same range as above was also measured. The results are shown in FIG. 1 (chain line 4).

It is noted from FIG. 1 that as in the case of Example 1, the specific heat capacity of the rare earth alloy in this example is less dependent on temperature than that of the conventional crystalline rare earth alloy. At very low temperatures below 2.7° K., the former is greater than the latter. At temperatures in the range of 2.7° K. to 6° K., the former remained in the range of about 1.5 to 2.0. This indicates that the amorphous rare earth alloy of the present invention exhibits good characteristics in specific heat capacity at very low temperatures like the above temperatures.

EXAMPLE 3

Figure 2:
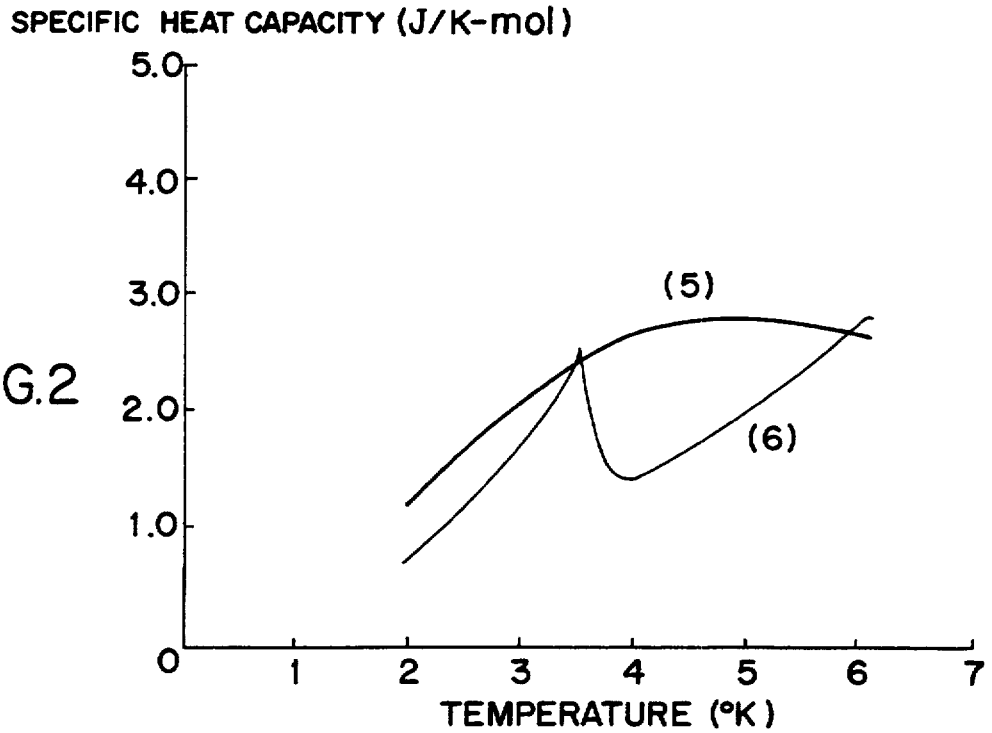
FIG. 2 is a graph showing the specific heat capacity vs. temperature of the amorphous rare earth alloy in Example 3 and the conventional rare earth alloy.

The same procedure as in Example 1 was repeated to prepare a rare earth alloy ($Er_{70}Ru_{30}$) composed of 70 atomic% Er and 30 atomic% Ru (purity 99.9%). The rare earth alloy was made into amorphous alloy foil (8 μm thick) by heating to about 1250° C. in the same manner as in Example 1. The specific heat capacity of the amorphous alloy foil at temperatures in the range of 1.6° K. to 6° K. was measured. The results are shown in FIG. 2 (line 5). For comparison, the specific heat capacity of a crystalline rare earth alloy ($Er_3Ru+Er_3Ru_2$) of the same composition as above at temperatures in the same range as above was also measured. The results are shown in FIG. 2 (line 6).

It is noted from FIG. 2 that the specific heat capacity of the crystalline rare earth alloy is unstable, greatly fluctuating at temperatures in the range of 3° K. to 4° K., whereas that the amorphous rare earth alloy in this example is larger than the former and stable in the same temperature range. This indicates that the amorphous rare earth alloy of the present invention exhibits good characteristics required of the regenerator.

EXAMPLE 4

The same procedure as in Example 1 was repeated to prepare several kinds of rare earth alloys each having the composition shown in Table 1. They were formed into amorphous alloy foil, and the specific heat capacity at temperatures in the range of 2° K. to 6° K. was measured. The results are shown in Table 1. It is noted that the amorphous rare earth alloys in this example change in specific heat capacity only a little in the specified range of temperatures. They have a large specific heat capacity at very low temperatures, which is desirable for their use as the regenerator.

TABLE 1

| Composition (molar ratio) | Thickness (μm) | Specific heat capacity (J/K-mol) 2° K. | 3° K. | 4° K. | 5° K. | 6° K. |
|---|---|---|---|---|---|---|
| 67.5Er—32.5Ni | 15 | 0.69 | 1.14 | 1.58 | 1.97 | 2.91 |
| 65Er—35Ni | 17 | 0.67 | 1.23 | 1.73 | 2.16 | 2.30 |
| 60Er—40Ni | 22 | 0.56 | 1.00 | 1.40 | 1.82 | 2.14 |
| 65Ho—35Ni | 22 | 0.68 | 0.32 | 1.08 | 1.41 | 1.79 |
| 65Dy—35Ni | 13 | 0.14 | 0.24 | 0.87 | 0.54 | 0.71 |
| 60Er—40Co | 15 | 0.34 | 0.56 | 0.82 | 1.11 | 1.37 |
| 60Ho—40Co | 13 | 0.71 | 0.64 | 0.78 | 1.01 | 1.29 |
| 70Er—30Ru | 8 | 1.06 | 2.09 | 2.70 | 2.81 | 2.60 |
| 80Dy—20Ru | 14 | 0.21 | 0.25 | 0.41 | 0.57 | 0.75 |

COMPARATIVE EXAMPLE 1

The same procedure as in Example 1 was repeated to prepare a rare earth alloy composed of 45 atomic% Er and 55 atomic% Ni, and the alloy was made into foil by injection toward the surface of a running roll. It was found by X-ray diffractometry that the crystalline phase remains in the foil. This indicates that the object of the present invention is not achieved if the content of rare earth element is less than 50 atomic%.

What is claimed is:

1. An amorphous rare earth alloy in the form of foil having a specific heat capacity of not less than 0.14 (J/K-mol) at a temperature under 6° K. for a refrigeration regenerator which comprises one or more rare earth elements selected from the group consisting of Er, Ho and Dy, in an amount of 50–99 atomic%, with the remainder being one or more iron family element selected from the group consisting of Ni, Co and Ru.

2. The amorphous material of claim 1 which further comprises one or more rare earth elements other than Er, Ho and Dy, wherein the total amount of rare earth elements is 50–99 atomic%.

3. The amorphous material for the regenerator of claim 1, which is in the form of amorphous foil prepared by quenching a melt of a rare earth alloy by injecting said melt toward the surface of a roll running at a high speed, said alloy being composed of one or more rare earth elements selected from the group consisting of Er Ho and Dy in an amount of 50–99 atomic%, with the remainder being one or more iron family element selected from the group consisting of Ni, Co and Ru.

4. The amorphous material of claim 3 which further comprises one or more rare earth elements other than Er, Ho and Dy, wherein the total amount of rare earth elements is 50–99 atomic% of said alloy.

5. The amorphous material of claim 1, wherein less than 50% of said one or more iron family element is replaced by one or more elements selected from the group consisting of Au, Ag, Cu, Al, Ga, Si and Ge.

6. The amorphous material of claim 1 which is $Er_{65}Ni_{35}$.

7. The amorphous material of claim 1 which is $Er_{60}Ni_{40}$.

8. The amorphous material of claim 1 which is $Er_{70}Ru_{30}$.

9. The amorphous material of claim 1 which is $Er_{67.5}Ni_{32.5}$.

10. The amorphous material of claim 1 which is $Ho_{65}Ni_{35}$.

11. The amorphous material of claim 1 which is $Dy_{65}Ni_{35}$.

12. The amorphous material of claim 1 which is $Er_{60}Co_{40}$.

13. The amorphous material of claim 1 which is $Ho_{60}Co_{40}$.

14. The amorphous material of claim 1 which is $Dy_{80}Ru_{20}$.

* * * * *